United States Patent [19]

Palmans

[11] Patent Number: 4,631,888

[45] Date of Patent: Dec. 30, 1986

[54] DEVICE FOR HOLDING A PANEL OR OTHER GENERALLY FLAT OBJECT ON A WALL

[75] Inventor: Jos Palmans, Sint-Huibrechts-Lille, Belgium

[73] Assignee: Alliance Enamelsteel Corporation N.V., Belgium

[21] Appl. No.: 774,308

[22] Filed: Sep. 10, 1985

[30] Foreign Application Priority Data

Oct. 16, 1984 [LU] Luxembourg ..... 85596

[51] Int. Cl.[4] ..... E04B 1/38

[52] U.S. Cl. ..... 52/509

[58] Field of Search ..... 52/378, 487, 509, 235, 52/513

[56] References Cited

U.S. PATENT DOCUMENTS 1,729,935 10/1929 Froehlich ..... 52/487
2,860,504 11/1958 Sinner et al. ..... 52/378
3,350,830 11/1967 Smith et al. ..... 52/487
3,535,846 10/1970 Storch ..... 52/509
4,070,835 1/1978 Reverend et al. ..... 52/235

*Primary Examiner*—James L. Ridgill, Jr.
*Attorney, Agent, or Firm*—Darby & Darby

[57] ABSTRACT

A fastener which is affixed to a wall and on which a panel or other generally flat object is placed and held in position. The fastener has at least one straight and flat edge. The fastener is a device to be used at least in twos. On one fastener rests the panel and the other fastener holds the top of the panel to the wall. The fastener is made up of two interacting pieces (1, 2) of which one, for hanging (1), to be affixed to the wall and the other, for holding in position (2), which can be engaged by or released from the first to fix or release the panel. The first piece (1) has the general shape of an essentially straight angle piece of which one branch (1') is arranged in such a way as to enable it to be fixed to the wall, and the other branch (1'') has an aperture (4) through which the second piece (2) can pass the second piece (2) is in the shape of a cross of which one part is longer than the other.

1 Claim, 15 Drawing Figures

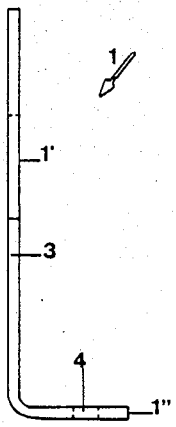
Fig.1
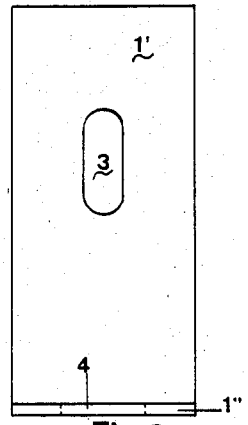
Fig.2
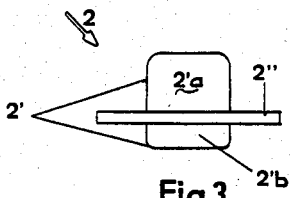
Fig.3
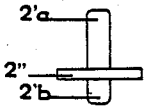
Fig.4
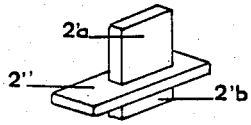
Fig.5
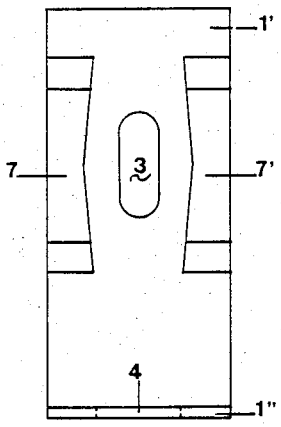
Fig.6
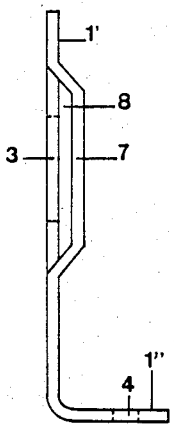
Fig.7
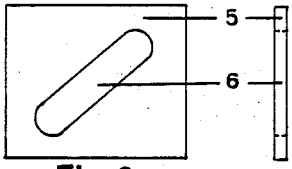
Fig.9
Fig.10
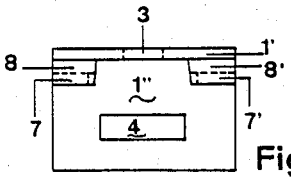
Fig.8

DEVICE FOR HOLDING A PANEL OR OTHER GENERALLY FLAT OBJECT ON A WALL

This invention relates to a fastener which can be fixed to a wall and on which can be placed and kept a panel or other generally flat object and which has at least one straight and flat edge. The fastener is to be used at least in twos, the panel being placed on one and the other holding the top of the panel to the wall.

The fastener consists of two separable pieces of such a nature that the panel can easily be taken down nevertheless without having to remove one of the devices from the wall, attachment of the devices to the wall being capable of concealment behind the panel.

There are very numerous types of fastening devices for hanging up panels but, either the device must first be released from the wall so that the panel can be taken down or, the panel has to be slid longitudinally out of the hanging device. This invention remedies these drawbacks.

SUMMARY OF THE INVENTION

The fastener of the present invention is characterized by the fact that it is made up of two interacting pieces of which one, for hanging, is affixed to the wall, and the other, for holding in position, can be engaged with or disengaged from the first to hold or release the panel, the first piece being in the general shape of an essentially straight angle piece of which one branch is arranged so that it can be fixed flat to the wall and of which the other branch includes an aperture to allow the second piece to pass, such second piece being in th form of a straight cross of which one branch can be slid equally well through one side or the other of the aperture in the first piece and the other branch, which is out of centre in relation to the first part comes to rest on the first piece.

When, in order to hold a panel, at least two fastening devices are used, one at the top, the other at the bottom of the panel, the second piece of the fastening device at the bottom of the panel is placed in the first piece, the panel is placed behind it and the second piece of the other, upper, device, is slipped into the first piece, such second piece coming in front of the panel and holding it in position.

In order better to understand the invention, it is now described in reference to the attached drawings, showing by way of example and unrestrictively:

BRIEF DESCRIPTION OF THE DRAWINGS in FIG. 1, a profile view of the first piece of the fastening device, in FIG. 2, a front view of the first piece of the device, in FIG. 3, a front view of the second piece of the device, in FIG. 4, a side view of the second piece of the device, in FIG. 5, a profile view of the second piece of the device, in FIG. 6, a front view of the first piece in a different form of embodiment, in FIG. 7, a profile view of the same piece as in FIG. 6, in FIG. 8, a plan view of the same piece as in FIGS. 6 and 7, in FIG. 9, a front view of a piece complementary to the piece in FIG. 6, in FIG. 10, a side view of the piece shown in FIG. 9, in FIG. 11 is a front view of the same piece in its second form of embodiment (FIGS. 6 and 8) and in which the complementary piece has been placed (FIGS. 9 and 10), FIG. 12 is a front view of a panel held up by four devices in accordance with the invention, FIG. 13 is an enlarged side view of FIG. 12, FIG. 14 is a front view of a picture held up by four devices in accordance with the invention, and FIG. 15 is an enlarged side view of FIG. 14.

DETAILED DESCRIPTION OF THE PREFERRED EMBODIMENTS

Figure 11:
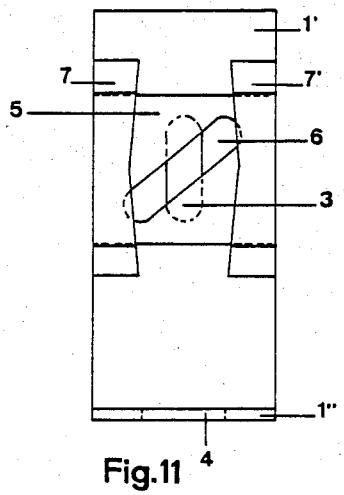

In these figures has been shown a fastening device, such as a panel fastener, made up of two pieces, a first bracket 1 for hanging first bracket or a panel or the like and generally made of metal, and a second bracket 2 for holding the panel in position. The first bracket or hanging piece 1 is shaped like a straight angle piece of which a first part portion, branch 1' includes an aperture or slot 3 intended to affix this piece to a wall by one means or another, for example a plug and a screw. The aperture 3 is preferably vertically oblong in such a way as best to adjust the height of the hanging piece 1. The hanging piece includes a flat second part portion, a branch 1' joined perpendicularly to the first portion 1, which includes an oblong aperture 4 parallel to the wall and intended to receive the holding piece 2.

The holding piece 2, which may be made of plastic, is generally in the shape of a straight cross of which one branch 2' perpendicular to the other branch 2'' is of the same dimensions as the aperture 4 of branch 1'' of the hanging piece 1. The branch 2' is preferably off-centre in relation to branch 2'' so that one part 2'a is appreciably longer than the other part 2'b.

Branch 2'' completely surrounds branch 2' so as to rest wholly on branch 1'' of the hanging piece when branch 2' of the holding piece 2 is inserted into it.

Part 2'a of the branch 2' of the holding piece 2 is sufficiently long to project far enough beyond the aperture 4 of the hanging piece 1 when the holding piece 2 is inserted into this aperture 4 by branch 2'a.

In order to provide for the height adjustment and fixing of the hanging piece 1 into the wall, provision can be made, as shown in FIGS. 6 to 11, for the use of a supplementary piece or locking plate 5. Locking plate 5 is a simple flat plate, usually formed of metal, having an oblong aperture or slot 6 formed through its thickness which extends obliquely to an aperture 3 formed in piece 1.

In order to cause this piece 5 to work with the hanging piece 1, the latter has first portion or branch 1' formed with a flat main body includes aperture or slot 3 formed through the thickness of the main body for mounting the fastener to a wall or mounting surface, and, to the side of the aperture or slot 3, on the face opposite that intended to be placed against the wall, two sockets. Each socket is defined as a lateral projecting portion 7, 7' of the first portion 1' which projects above the level of the main body, and includes a slot 8, 8' defined by the respective projecting portion 7, 7' and the main body. As shown in FIGS. 6 and 7, each slot 8, 8' extends longitudinally of piece 1 and is open laterally with respect to piece 1. Supplementary piece or locking plate 5 is dimensioned to be slidingly received and retained by slots 8, 8'.

As with the previously described embodiment, the hanging piece or first bracket 1 includes a flat second portion 1'', which includes an aperture 4 formed through its thickness. A second bracket or holding piece 2 includes a first elongated member 2'b which is received by aperture 4, and a second cross member 2'' joined to and extending transversely to the first member 2'b for securing a panel to hanging piece 1.

The apertures 3 and 6 respectively of the hanging piece or locking plate 5 1 and the supplementary piece 5 intersect one another (FIG. 11) and lock the hanging piece 2 to the fixing facility, for example a screw, on the hanging piece 1, to the wall. By moving the supplementary piece 5 in relation to the hanging piece 1, it will be possible to alter the vertical position of the hanging piece 1 in relation to the fixing facility that is to say the wall.

Figure 13:
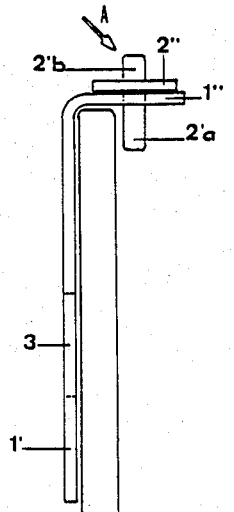
Figure 12:
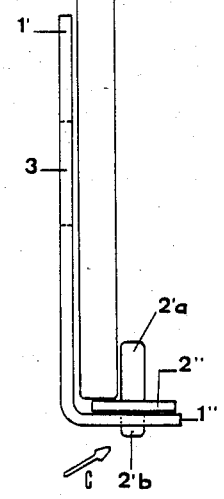
Figure 12:
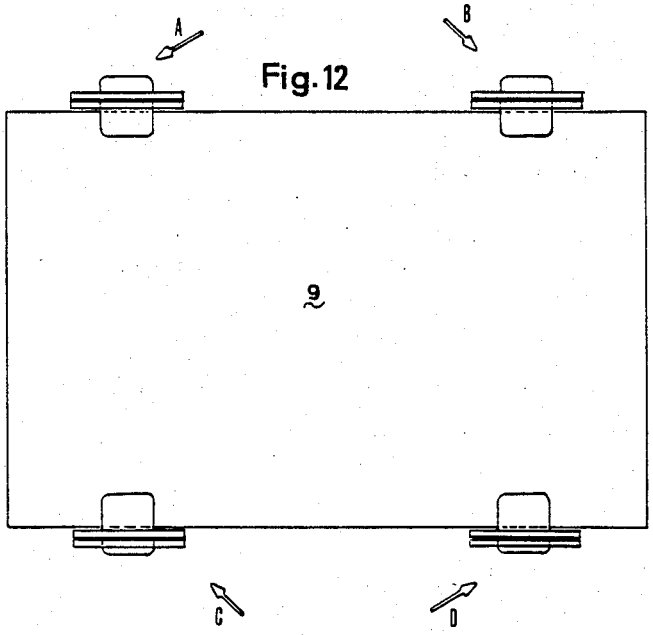

Devices in accordance with the invention are illustrated in FIGS. 12 and 13. Four devices A, B, C, D have been provided for haning a panel 9, but of course ony two could be provided, one above and the other below, or three, two below and one above.

Having affixed the four hanging pieces 1 at a desired height to the wall, those of the height of A, B in the reverse position to those at the lower level C, D, this being moreover purely for aesthetic reasons and in order to conceal the wall fixings behind the panel, that is, the 1' branches of the hanging pieces 1 of which the ends face one another; in the two hanging pieces 1 at lower level C, D, are placed the two holding pieces 2, part 2'b of branch 2' in the aperture 4 in such a way that the longer part 2'a extends upwards and inwards and branch 2'' rests internally on branch 1'' of the hanging piece 1. The panel 9 is then inserted behind branches 2'a and it is brought into the hanging position; the two holding pieces 2 are then slipped into the aperture 4 of the two hanging pieces 1 at the height of A, B, part 2'a of branch 2' of such pieces 2 being foremost. The latter protrude beyond the aperture and in front of the panel and hold it in position. In this case, the pieces 2 are placed outside on their branch 2'', resting on hanging piece 1. Panel 9 is however held safely in position, but it is quite easy to take it down: the two holding pieces 2 at the height of A, B, need only to be removed and then the panel lifted out of the holding pieces 2 at the lower level C, D.

Figure 14:
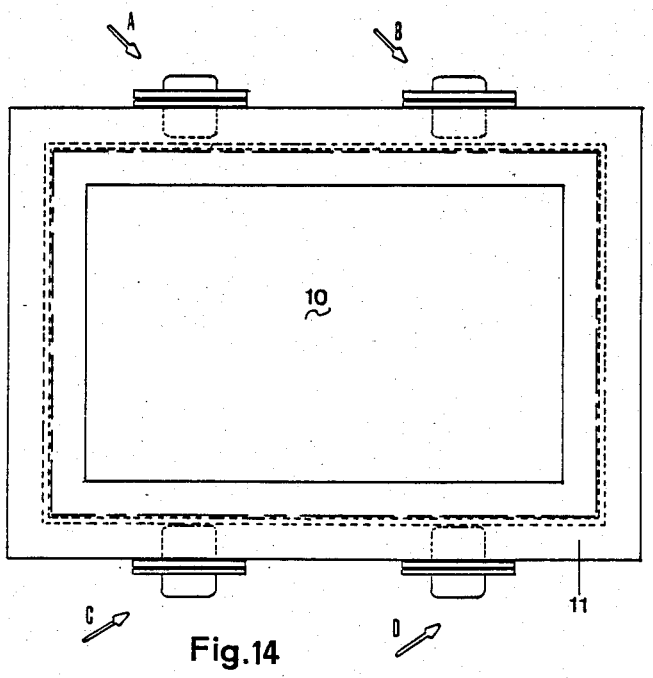
Figure 15:
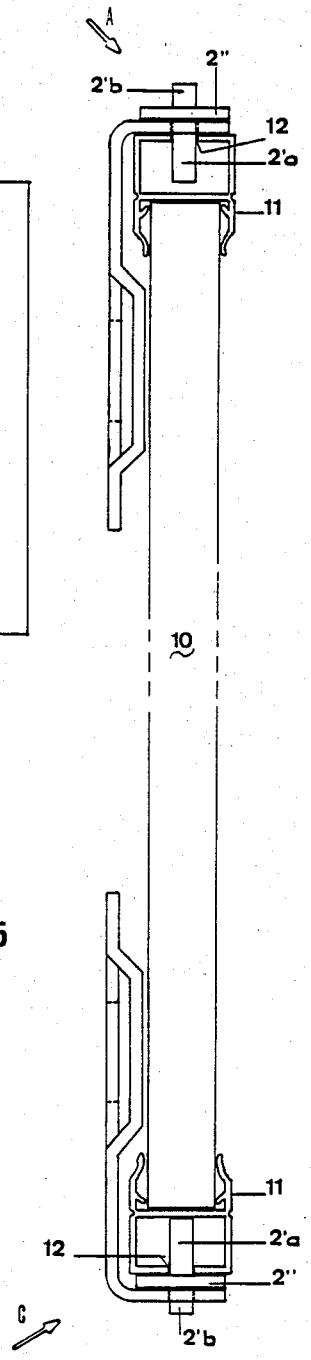

In one possible form of embodiment of the invention as described is intended to hold up a blackboard, thin pieces of pliable material can be provided behind the latter or, as illustrated in FIGS. 14 and 15, slots 12 made to fit the thickness of the branches 2' of the holding piece 2 can be provided in the section forming the framework 11 of the blackboard 10, which prevents possible wobbling of the blackboard. Where these arrangements are provided, the board 10 is placed into the slot 12 in their framework on to the parts 2'a of the holding pieces 2 already positioned at the lower level C, D and then, part 2'a of the holding pieces 2 is introduced through the apertures 4 of the hanging pieces placed above at A, B and in the slot 12, the blackboard will be held safely in position.

What is claimed is:

1. A panel fastener, which comprises:

a first bracket, the first bracket including a first portion, and a flat second portion joined perpendicularly to the first portion, the first portion including a flat main body and a pair of laterally projecting portions projecting above the level of the main body, the main body including a slot formed through the thickness thereof for mounting the fastener to a mounting surface, and each of the projecting portions defining with the main body a respective slot extending longitudinally of the first bracket and open laterally with respect thereto, the second portion including an aperture formed through the thickness thereof;

a second bracket adapted to mate with the first bracket to secure a panel to the first bracket, the second bracket including a first elongated member dimensioned to be received by the bracket aperture, and a second cross member joined to and extending transversely to the first member; and a flat, locking plate for locking the fastener in position on the mounting surface, the locking plate being dimensioned to be slidingly received and retained by the slots defined by the projecitng portions and the main body, the locking plate including a slot formed through the thickness thereof and disposed to extend obliquely to the slot formed in the main body of the first bracket.

* * * * *